US010553342B2

(12) United States Patent
Lazarus et al.

(10) Patent No.: US 10,553,342 B2
(45) Date of Patent: Feb. 4, 2020

(54) DEFORMABLE INDUCTOR HAVING A LIQUID MAGNETIC CORE

(71) Applicant: U.S. Army Research Laboratory ATTN: RDRL-LOC-I, Adelphi, MD (US)

(72) Inventors: Nathan S. Lazarus, Bethesda, MD (US); Christopher D. Meyer, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 428 days.

(21) Appl. No.: 15/209,115

(22) Filed: Jul. 13, 2016

(65) Prior Publication Data

US 2018/0019049 A1 Jan. 18, 2018

(51) Int. Cl.
*H01F 1/44* (2006.01)
*H01F 27/02* (2006.01)
*H01F 27/24* (2006.01)

(52) U.S. Cl.
CPC ..... *H01F 27/022* (2013.01); *H01F 27/24* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS 3,255,512 A * 6/1966 Lochner ..... H01F 27/022 29/602.1
3,287,677 A 11/1966 Mohr
3,917,538 A 11/1975 Rosenweig
4,329,241 A 5/1982 Massart
5,547,049 A * 8/1996 Weiss ..... F16F 9/535 188/267.2
5,683,615 A 11/1997 Munoz
(Continued)

FOREIGN PATENT DOCUMENTS

CN 103366915 A * 10/2013
JP 56081906 A * 7/1981 ..... C08G 59/68
JP 2013201375 A * 10/2013 ..... H01F 41/04

OTHER PUBLICATIONS

Markus Zahn, "Magnetic fluid and nanoparticle applications to nanotechnology," Journal of Nanoparticle Research 3: 73-78, 2001.
(Continued)

*Primary Examiner* — Tszfung J Chan
(74) *Attorney, Agent, or Firm* — Eric B. Compton

(57) ABSTRACT

A deformable inductive device includes an elastomer material having at least one deformable electrode and a liquid magnetic core formed in the elastomer material and containing a magnetic liquid. Depending on the device's configuration, the deformable element may be embedded in, attached to, or in close proximity with the liquid magnetic core. In some embodiments, the deformable inductive device may be configured as an inductor, solenoid, or transformer and the deformable electrode is at least partially embedded in the liquid magnetic core, for instance. In another embodiment, the deformable inductive device may be configured as part of a wireless power transfer system which includes a coil and a magnetic backplane having the liquid magnetic core with the coil being attached to or in close proximity to the magnetic backplane.

20 Claims, 8 Drawing Sheets

(56) References Cited

U.S. PATENT DOCUMENTS

| | | | | |
|---|---|---|---|---|
| 6,229,424 | B1 * | 5/2001 | Tajima | H01F 21/08 336/110 |
| 6,242,994 | B1 * | 6/2001 | Li | H01F 7/088 251/129.01 |
| 6,340,080 | B1 * | 1/2002 | Carlson | A63B 21/0056 188/267 |
| 6,464,968 | B2 | 10/2002 | Riffle et al. | |
| 7,477,123 | B2 | 1/2009 | Beerling | |
| 7,875,955 | B1 * | 1/2011 | Hopper | H01F 17/0006 257/516 |
| 8,286,335 | B2 * | 10/2012 | Determan | B23K 35/00 242/437.3 |
| 9,479,007 | B1 * | 10/2016 | Jol | H02J 7/025 |
| 2007/0098199 | A1 * | 5/2007 | Goldberg | A42B 3/30 381/376 |
| 2012/0161579 | A1 * | 6/2012 | Browne | F15B 15/10 310/330 |
| 2012/0186003 | A1 * | 7/2012 | Heger | A41D 13/015 2/412 |
| 2012/0235636 | A1 * | 9/2012 | Partovi | H02J 7/025 320/108 |
| 2014/0042756 | A1 * | 2/2014 | Browne | E05C 19/16 292/251.5 |
| 2015/0303786 | A1 * | 10/2015 | Jeong | H02K 44/00 290/1 A |
| 2016/0163451 | A1 * | 6/2016 | Wang | H01F 41/042 336/192 |

OTHER PUBLICATIONS

S. P. Lacour, S. Wagner, Z. Huang, and Z. Suo, "Stretchable gold conductors on elastomeric substrates," Applied Physics Letters, vol. 82, No. 15, Apr. 2003, 2404-2406.

D. S. Gray, J. Tien, and C. S. Chen, "High-Conductivity Elastomeric Electronics," Adv. Mater., pp. 393-397 (Feb. 2004).

H. Hartshorne, et al., "Ferrofluid-based microchip pump and value," Sensors and Actuators B, vo. 99, 2004, pp. 592-600.

J. Engel, J. Chen, N. Chen, S. Pandya, and C. Liu, "Multi-walled carbon nanotube filled conductive elastomers: Materials and Application to Micro transducers," Proc. MEMS 2006, pp. 246-249.

D. Lee, et al., "Fabrication and analysis of high-performance integrated solenoid inductor with magnetic core," IEEE Trans. 2008 Magn. 44 4089-95.

H. Kim, T. Maleki, P. Wei, and B. Ziaie, "A biaxial stretchable interconnect with liquidalloy-covered joints on elastomeric substrate," J. Microelectromech. Syst., vol. 18, No. 1, Feb. 2009 pp. 138-146.

A. Pettersson,et al., "Design of a magnetorheological robot gripper for handling of delicate food products with varying shapes," J. Food Engineering, vol. 98, 2010, pp. 332-338.

T. Tsai, et al., "Applications of Ferro-nanofluid on a microtransformer," Sensors, vol. 10, 2010, pp. 8161-8172.

D. Kim et al., "Epidermal Electronics," Science, vol. 333, Aug. 2011, pp. 838-843.

E. Kortoglu, et al., "Ferrofluid actuation with varying magnetic fields for micropumping applications," Microfluid Nanfluid, 2012.

A. Fassler and C. Majidi, "Soft-matter capacitors and inductors for hyperelastic strain sensing and stretchable electronics," Smart Mater. Struct., vol. 22, 2013, 055023 (8pp).

B. Assadsangabi, et al., "Planar variable inductor controlled by ferrofluid actuation," IEEE Trans. on Magnetics, vol. 49, No. 4, Apr. 2013, pp. 1402-1406.

C. Keplinger, J. Sun, C. C. Foo, P. Rothemund, C. M. Whitesides, and Z. Suo, "Stretchable transparent ionic conductors," Science, vol. 341, Aug. 2013 pp. 984-987.

Lazarus, N.; Meyer, C. D.; Bedair, S. S.; Nochetto, H.; Kierzewski, I. M. "Multilayer Liquid Metal Stretchable Inductors," Smart Mater. Struct. 2014, 23, 085036.

N. Lazarus, C. D. Meyer and S. S. Bedair, "Stretchable Inductor Design," IEEE Transactions on Electron Devices, vol. 62, No. 7, pp. 2270-2277, Jul. 2015.

N. Lazarus and C. D. Meyer, "Ferrofluid-based Stretchable Magnetic Core Inductors," Journal of Physics: Conference Series 660 (2015) 012007 (paper presented Dec. 2, 2015 at the PowerMEMS 2015 Conference, Dec. 1-4, 2015, Boston Massachusetts).

N. Lazarus and C. D. Meyer, "Stretchable inductor with liquid magnetic core," Mater. Res. Express 3 (2016) 036103, which published Mar. 18, 2016.

U.S. Appl. No. 15/144,995, filed May 3, 2016 titled "Deformable Inductive Devices Having a Magnetic Core Formed of an Elastomer With Magnetic Particles Therein Along With a Deformable Electrode".

U.S. Appl. No. 15/149,731, filed May 9, 2016 titled "Self Cooling Stretchable Electrical Circuit Having a Conduit Forming an Electrical Component and Containing Electrically Conductive Liquid".

* cited by examiner

DEFORMABLE INDUCTOR HAVING A LIQUID MAGNETIC CORE

GOVERNMENT INTEREST

The invention described herein may be manufactured, used and licensed by or for the U.S. Government without the payment of royalties thereon.

BACKGROUND OF THE INVENTION

Field

Embodiments of the present invention generally relate to inductive electrical components, such as inductors or transformers.

Description of Related Art

Magnetic materials are commonly used in inductor and transformer cores to increase inductance density. These materials are typically rigid and poorly suited for stretchable devices.

U.S. patent application Ser. No. 15/144,995, recently filed and incorporated by reference in its entirety, discloses deformable inductive devices having a magnetic core formed of an elastomer loaded with magnetic particles along with a deformable electrode. Results show that the elastomer loaded with magnetic particles increases the effective permeability of the core while retaining the ability to stretch without permanent damage. One disadvantage of this approach, however, is that the resulting loaded elastomer composite has different mechanical properties from the original elastomer material. Embedded particles result in a stiffer composite, which could be less desirable for mechanically matching with soft substrates. This believed to occur because the embedded particulate material serves to cross-link neighboring polymer chains, similar to vulcanized rubber, resulting in increased elastic modulus. The need to maintain stretchability also limits the maximum concentration of rigid particulate, and therefore the maximum permeability.

Further improvements in stretchable and deformable inductive electrical components would be useful.

SUMMARY OF THE INVENTION

Embodiments of the present invention include deformable inductive electrical components, such as inductors or transformers, which are able to undergo significant strains.

According to an embodiment, a deformable inductive device includes an elastomer material having at least one deformable electrode and a liquid magnetic core formed in the elastomer material and containing a magnetic liquid. The devices are deformable in as much as they enable significant strain in tension, compression, and/or mixed modes, such as caused by twisting or bending, without failure.

Depending on a particular device's configuration, the deformable electrode may be embedded in, attached to, or in close proximity with elastomer material. For instance, the deformable inductive device may be configured as an inductor, solenoid, or transformer and the deformable electrode is at least partially embedded in the elastomer material, in some embodiments. In others, the deformable inductive device may be configured as part of a wireless power transfer system which comprises a coil and a magnetic backplane which includes the liquid magnetic core with the coil being attached to or in close proximity to the magnetic backplane.

The elastomer material may be a polymer or plastic material, such as a natural rubber or a silicone material. The magnetic liquid may be a fluid having magnetic particles dispersed within. For example, the fluid may be mineral oil and the magnetic particles may have a size on the order of about 10 nm. The magnetic particles may be formed of iron, nickel, cobalt and/or an alloy thereof, or carbonyl iron, as examples. They may be generally spherical particles or platelets.

The magnetic liquid may be a ferrofluid or magnetorheological fluid. Ferrofluids may be formed of a viscous carrier liquid, magnetic particles dispersed therein, and optionally an additive (also known as a surfactant) to prevent clumping. The magnetic particles for a ferrofluid may be sized less than about 50 nanometers, for example, to result in a stable suspension (so that the magnetic particles do not settle to the bottom). Magnetorheological fluids use bigger particles than ferrofliuds (typically greater than 50 nm, and most commonly in the low microns) in a carrier fluid, such that the particles will settle out of solution and clump. When a magnetic field is applied, force between the particles resists motion, causing it to become more viscous.

In some cases, the deformable electrode may be formed of at least one deformable conductive trace. The deformable conductive trace might be about 500 nm thick and 100 μm wide, for example. In other cases, the deformable electrode might be a coil having one or more turns. And, in yet other cases, the deformable electrode may be at least one deformable channel containing a containing a liquid conductor. The liquid conductor can include a liquid metal (e.g., Galinstan, eutectic gallium/indium, or mercury), a flowable elastomer or polymer having conductive particles intermixed therein, or a fluid solution containing an ionic conductor or electrolyte.

The deformable inductive device is configured to be deformable in excess of at least +5% strain (in tension), and/or may also be deformable in excess of at least −5% strain (in compression). A greater degree of stretching may be more advantageous than for compression in some instances. Or vice-versa in others. For many practical embodiments, the deformable inductive device might be configured to be deformable from about −50% strain to about 100% strain, for example.

In further embodiments, a method for forming the deformable inductive device includes the steps of: preparing a mold, the mold including a removable element which will form the liquid magnetic core in the elastomer material; casting elastomer material into the mold; removing the removable element; and filling the void in the elastomer material left by the removable element with the magnetic liquid.

These and other embodiments of the invention are further discussed below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. The drawings are not to scale unless so stated. It is to be noted, however, that the appended drawings illustrate only typical embodiments of this invention and are therefore not to be considered limiting of its scope, for the invention may admit to other equally effective embodiments. These embodiments are intended to be included within the following description and protected by the accompanying claims.

FIGS. 3A-3D depict an analytical model developed for modeling the effects of strain on a liquid magnetic core solenoid inductors, in which FIG. 3A shows the solenoid in an initial state, FIG. 3B shows the solenoid after being stretched, and FIGS. 3C and 3D show the bottom and cross-sectional views of the solenoid, respectively, along with some key parameters of the solenoid identified;

DETAILED DESCRIPTION

Figure 1:
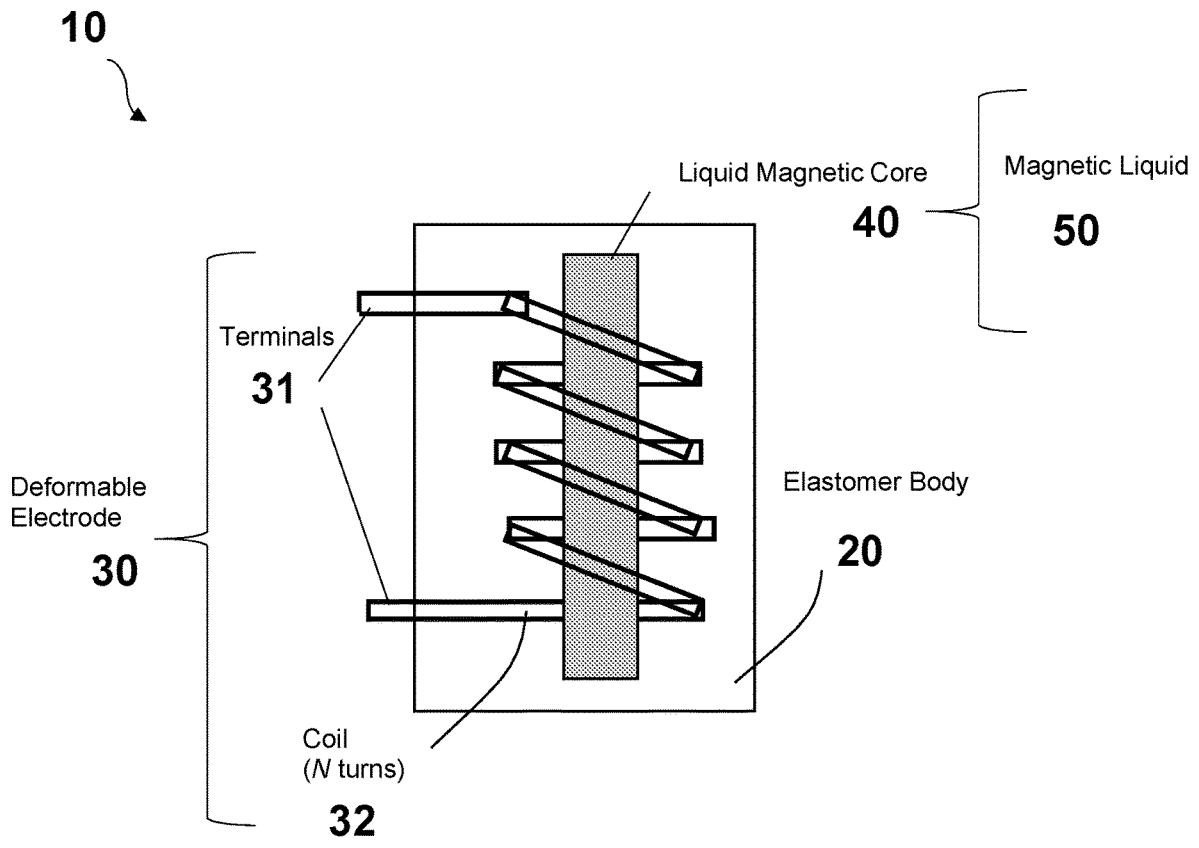
FIG. 1 is a top plan schematic showing a deformable inductor according to one exemplary embodiment of the invention.

Novel deformable and stretchable electrical inductive devices include a deformable inductive device includes an elastomer material having at least one deformable electrode and a liquid magnetic core formed in the elastomer material and containing a magnetic liquid. More particularly, the elastomer material includes at least one void, recess and or channel containing a magnetic liquid to create a magnetic core inductor able to undergo very large strains. Using a magnetic liquid allows the magnetic core to be made deformable or stretchable while having minimal effect on the overall mechanical behavior of the inductive devices.

The deformable inductive devices may be configured to generate a magnetic field or fields from electrical energy, generate an electrical energy from magnetic fields, or both. Such devices may include inductors, solenoids, or transformers, for instance. In some embodiments, the inductive device could also be used to improve magnetic coupling between coils in an electrical transformer or a wireless energy transfer system.

Being "deformable" refers herein to degree of elasticity, i.e., the ability of the device to change shape or size with force applied and then to return to original shape without permanent deformation (or plastic deformation) when the force is removed. The amount of deformation may be reported in terms of strain. Strain, as conventionally used in the art, refers to the relative change in shape or size due to externally-applied forces. It is dimensionless and thus has no units associated with it; usually, it is reported as a percentage (%). Uniaxial strain is strain which is substantially related to, or affecting, substantially only one axis. Biaxial strain is strain in two perpendicular axes. The degree of deformation as a function of stress, i.e., strain, may vary in different directions and the performance thereof as a result of the geometry of the device. Tensile strain is the result of elongation or lengthening due to stretching and is generally reported as a positive value. On the other hand, compressive strain is the result of shortening due to compressing and is generally reported as a negative value. Deformations may vary in different directions and the performance thereof as a result of the geometry and/or configuration of a particular device, and the locations and amount of force(s) applied. The inductor embodiments may be configured to be deformed and sufficiently maintain conductive performance during tension (stretching), compression (squeezing), and/or mixed mode deformations, like twisting, while maintaining or controlling performance.

A greater degree of tensile deformation or stretching may be more advantageous than for compressing in some instances. Or, perhaps, vice-versa in other instances. For practical applications of the invention, though, the novel deformable inductive device structures should be able to survive repeated strains of tens to hundreds of percent. In exemplary embodiments and applications, especially for power, the devices may be configured to be deformed from about −50% strain (in compression) to about 100% strain (in tension). This would be true in any direction of strain being applied, not just parallel and perpendicular directions. It is noted that the inventors tended to focus more on tensile strain in their initial research because that was easier to test and they believed more likely to occur for many applications (e.g., electrical devices positioned on the surface of the skin). Thus, while stretchable embodiments are primary disclosed herein, it should be appreciated that both tensile and compressive strains are possible for various embodiments of the invention should work equally well in both. That being said, term "deformable" as used herein is intended to encompass both tensile, compressive, and/or mixed modal strains, such as caused by twisting or bending.

While the terms "flexible" and "deformable" may be used somewhat interchangeably in the art, the inventors believe that they concern varying degrees of elasticity and is worth noting here. For instance, while there may not be universally agreed upon definitions, they agree "flexible" means a generally low amount of elasticity, e.g., less than ±5% strain, whereas "deformable" means a more substantial amount of elasticity, e.g., greater than about ±5% strain.

FIG. 1 is a top plan schematic showing a deformable inductor 10 according to an embodiment of the invention. This inductor 10 and other deformable induction devices are formed of an elastomer 20, one or more deformable electrodes 30 embedded in, attached to, or in close proximity with the elastomer 20, and a liquid magnetic core 40. The inductor 10 shown includes a single electrode coil 30 embedded within the elastomer 20. The liquid magnetic core 40 is formed in the elastomer 20 and contains a magnetic liquid 50.

Thus, by the core 40 being formed 'in' the elastomer 20, the elastomer material itself should be thought of as basically forming and defining the boundaries of the core region. For instance, that means that the elastomer material 20 substantially surrounds at least one void, recess, and/or channel in the elastomer material 20 which, when ultimately filled with magnetic liquid 50, forms the liquid magnetic core 40 in the final device.

The entire inductor 10 may be a few hundredths of an inch (or a few millimeters) up to perhaps ten inches or even larger; some embodiments may be about an inch in diameter. Other deformable inductive devices may be differently configured.

The elastomer 20 can be a polymer or plastic material that is characterized as having a high degree of elasticity. It should be in a non-liquid (solid) state for anticipated operational temperatures of the inductor 10. In general, the elastomer 20 should be able to stretch (or compress) by a large amount without undergoing permanent (or plastic) changes in the material. This would be at least 5% strain (and/or −5% strain), but should be even much more to be practical, such as in excess of 10% strain (and/or −10% strain). Exemplary elastomer materials which can be used for the elastomer 20 may include, but are not necessarily limited to: rubber materials (including natural rubber), silicone, polyurethane and nitrile. They elastomers are not intended to be magnetic. The elastomer (or precursors of the elastomer) may be in a liquid state which then cures or otherwise solidifies. In the case of a thermoplastic elastomer, heat melts the material. For thermoset elastomers, precursor materials may be liquids mixed together which will react to form the elastomer. For example, the soft silicone, Ecoflex 00-30, is obtained as a two part formulation of liquid precursors A and B, which are mixed in equal parts to react and cure into a solid rubber material.

The deformable electrode(s) 30 can be fully or partially embedded or encapsulated in the elastomer 20 while is in a liquid state. For instance, the elastomer material 20 may be poured or cast around the deformable electrode 30. Then, the elastomer material cools or reacts to solidify about the electrode 30. This same technique can be used for forming one or more interior voids, recesses, or channels in the elastomer material 20 which later will form the liquid magnetic core 40. Such voids in the elastomer which contains the magnetic liquid 50 would not ordinarily be visible given their interior location. An elongated channel forming the core 40 is generally shown in the drawings and discussed herein, but other geometries could be used too.

In some embodiments, a mold may be used to shape the elastomer 20 forming the core 40 to its shape and size. Excess material may be milled or machined to provide final dimensions to the channel which will define the core 40, if so desired. Beyond that, it is necessary to have some way to put the magnetic liquid 50 into the channel of the elastomer 20. According, some inlet and/or outlet is needed. These may be temporary orifices, in the case, the liquid 50 is injected into the channel such as via a syringe. The channel can be filled with liquid 50 and the inlet/outlet plugged or otherwise closed. For instance, additional elastomer can be used to close the orifice(s), whether by casting or melting.

Alternatively, the elastomer 20 may be three-dimensional (3-D) printed with voids, recesses and/or channels which will later form the core 40 when filled with magnetic liquid 50. Also, the elastomer 20 could be formed in multiple pieces having voids, recesses or channels which when later joined together will form the core region 40.

For a power device application, the channel (in the elastomer 20) would preferably be fully filled with the magnetic liquid 50 (i.e., no void); however, there are other scenarios where an incomplete fill still might be useful. One such possibility is to make a tunable device, where the percentage of the cavity filled with ferrofluid is changed to tune the device. Another might be pumping, where beads of ferrofluid might be used to move a fluid made primarily of some other fluid.

The liquid magnetic core 40 can be any (almost) geometry. Permeability is one of the factors that dictate the core performance. One skilled in the art should be able to design the geometry for a particular inductor application as desired.

The deformable electrode 30 can be fully or partially encapsulated in the elastomer 20. The terminals 31 of the electrode 30 as shown are exposed for connecting to an electrical circuit (not shown), in any conventional manner. While they are shown as non-encapsulated in this drawings, the terminals and circuit might be fully encapsulated in other embodiments. In practice, the deformable inductive components could be sized to be on the order of centimeter scale in some cases; if smaller than that there may not be a need for the device to be stretchable/compressible, and if too much larger, the devices could become too large and impractical for conventional-type use.

The deformable electrode 30 may be any inductive element. As shown, the electrode 30 is a coil element 32 having one or more turns. Adding additional turns to an inductor coil is a common method for increasing the inductance density, and also results in a higher coupling for inductive power transfer. For this particular type of device, a coil 30 with turns of a few millimeters to a hundred millimeters in diameter may be sufficient; too small, there may be no need for deformability (e.g., stretchability); too large, and it may not be very useful for certain applications, such as inductive sensors located on the human body.

The deformable electrode 30 is formed of one or more electrical conductors. It may be 2-D planar (in the case or a simple trace) or 3-D (in the case of a complex trace or multi-turn coil) in shape. In some embodiments, the deformable electrode may be a pre-deformed (or pre-wrinkled) conductive trace, formed of a deformable electrically conductive metal, such as copper or gold. These electrodes have a generally serpentine- or accordion-shaped structure with one or more deformable sections that are configured to minimize internal stresses when stretched (or compressed). Exemplary techniques for forming stretchable conductors have previously been described by S. P. Lacour, S. Wagner, Z. Huang, and Z. Suo, "Stretchable gold conductors on elastomeric substrates," Applied Physics Letters, vol. 82, no. 15, April 2003, 2404-2406, and N. Lazarus, C. D. Meyer and S. S. Bedair, "Stretchable Inductor Design," *IEEE Transactions on Electron Devices*, vol. 62, no. 7, pp. 2270-2277, July 2015, herein incorporated by reference in their entireties. These techniques can likewise be used to form stretchable and/or compressible electrodes according to embodiments of the present invention.

In some embodiments, a layer of an elastomer (such as silicone) may be provided between the electrode and the core containing magnetic liquid for isolation. This is not limiting. For instance, a deformable electrode 30, such as a wire trace with periodic waves, could be in direct contact with the magnetic liquid 50 in or next to the core 40.

Having the coil 32 wrapped around the liquid magnetic core 40 (as in the figure) is one possible implementation, creating a type of an inductor known as a solenoid (or a variant known as a toroid, i.e., where the core 40 is a donut shape and the trace is again wrapped around). It is also possible to have the core 40 formed over or underneath a stretchable planar coil (to improve wireless power coupling).

In general, the magnetic liquid 50 is comprised of any material in a liquid state at operational temperatures which is configured to have magnetic properties. One specific class of magnetic liquids which may be used in some embodiments is referred to herein as "ferroliquid" or "ferrofluid." (It is noted that while the term "ferro-" may imply the presence iron (Fe) or ferrite in the liquid, it is not intended to be limited to just iron or iron alloys, and can be formed of various materials, as further described herein).

Figure 1A:
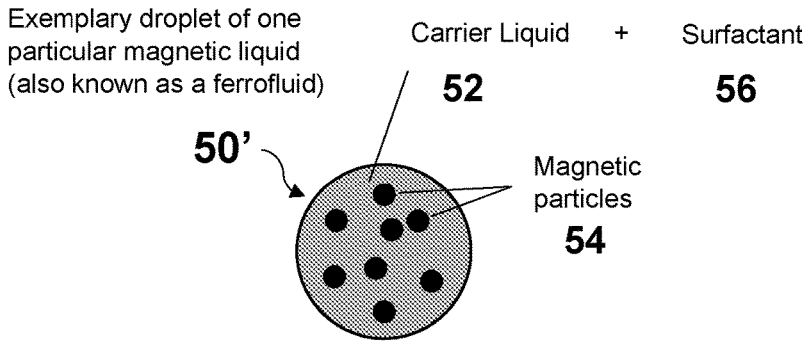
FIG. 1A shows a schematic of an exemplary drop of ferrofluid which is one particular type of magnetic liquid according to some embodiments.

FIG. 1A shows a schematic of one exemplary drop of ferrofluid 50' which is one particular type of fluid which may be used for the magnetic liquid 50 in FIG. 1 according to some embodiments. The ferrofluid 50' may be formed of a viscous carrier liquid 52, magnetic particles 54 dispersed therein, and optionally an additive (also known as a surfactant 56) to prevent clumping. For carrier liquids, mineral oil is by far the most common, but other possibilities include silicone oil, water, glycerin, and propylene and ethylene glycol to name a few. The magnetic particles may be sizes less than about 50 nanometers to result in a stable suspension (so that the magnetic particles do not settle to the bottom). Other types of magnetic particles could be used (such as nickel, iron, cobalt, and several of their oxides, among others); the particle size, as stated above, is less than 50 nm. The particle sizing in a ferrofluid is pretty-well controlled for.

The individual magnetic particles 54 may on the order of ten microns. They may be of various shapes, such as spherical and platelet geometries, although, it has been found that platelets actually do somewhat better due to their anisotropy. The particles 54 may be any soft magnetic material, such as iron, nickel, cobalt as elemental metals, as well as a large number of alloys, including such metals or others. Carbonyl iron may also be used, for instance. Some commercial ferrofluids which may be used in embodiments include, Ferro-Tec EFH-1 and EMG-900, for instance. These particular ferrofluids are formed of magnetite particles in mineral oil.

The surfactants 56 may include oleic acid, tetramethylammonium hydroxide, citric acid and soy lecithin, as examples. Since ferrofluids with relative permeabilities above ten are commercially available, a sizeable improvement in inductance density is possible for a stretchable inductor by switching to a liquid magnetic core. The liquid magnetic core 40 also does not affect the mechanical properties of the surrounding elastomer 20.

Filling the core 40 with a ferrofluid 50' was found to increase the unstrained inductance by as much as 280% compared with a similar unfilled inductor for the higher permeability fluid used, compared with a maximum increase of less than 200% for the ferroelastomer core as disclosed in the aforementioned '995 application. Inductors were also demonstrated to reach uniaxial strains up to 100% without permanent damage.

Magnetorheological fluids are another class of magnetic liquid 50 which may be used in other embodiments. Magnetorheological fluids use bigger particles than ferrofluids (typically greater than 50 nm, and most commonly in the low microns) in a carrier fluid, such that the particles will settle out of solution and clump. When a magnetic field is applied, force between the particles resists motion, causing it to become more viscous. The same carrier fluids may be used as the ones in ferrofluids. The mechanical properties of magnetorheological fluids can be tuned using an applied magnetic field.

Since the magnetic core 40 contains magnetic liquid 50, the mechanical behavior will remain dominated by elastomer 20, which is more desirable for most applications.

Figure 2A:
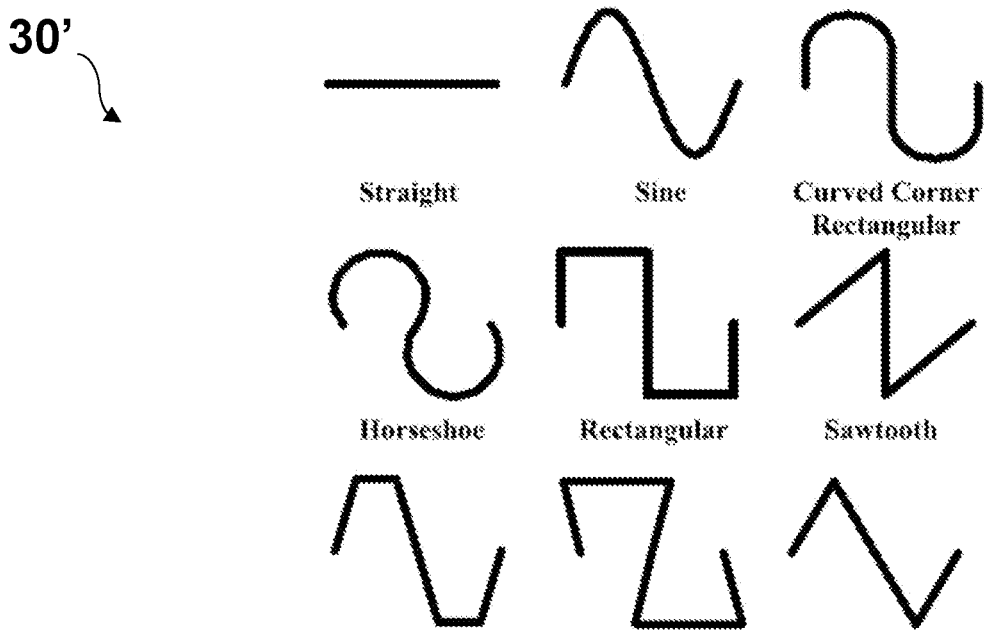
FIG. 2A shows various deformable conductor trace shapes which may be used in accordance with various embodiments.

FIG. 2A shows various trace shapes 30' which are deformable which may be used. They include straight, sinusoidal curved corner, horseshoe shaped, rectangular and triangular sawtooth, and many trapezoidal shapes, as examples. The traces may be formed of copper and be about 500-nm thick and 100-μm wide, for example.

Figure 2B:
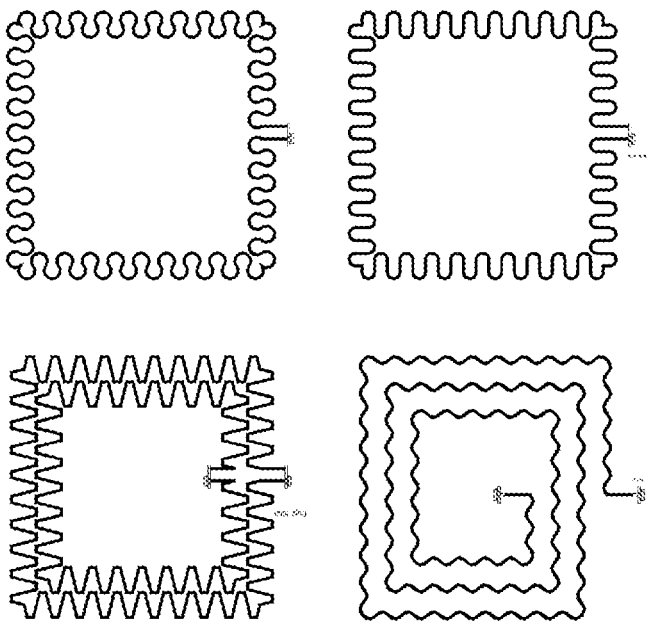
FIG. 2B shows illustrations of four fabricated deformable wavy inductor traces.
Figure 3A:
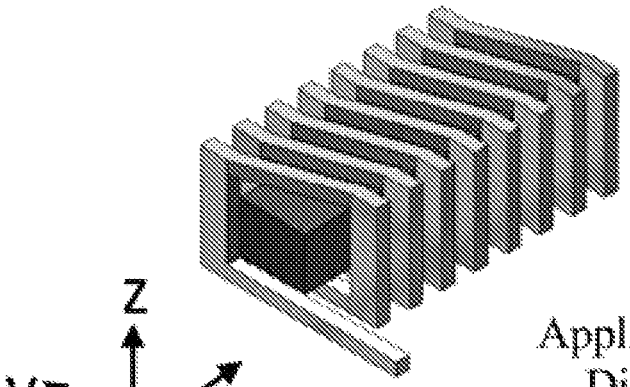
Figure 3B:
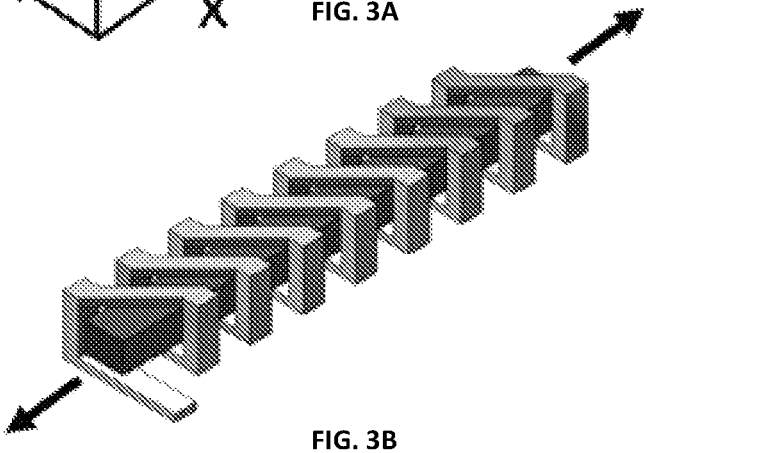
Figure 3C:
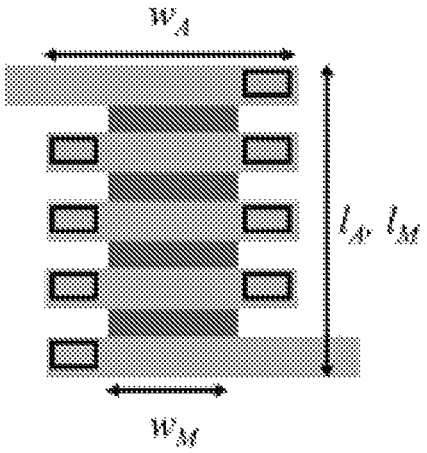
Figure 3D:
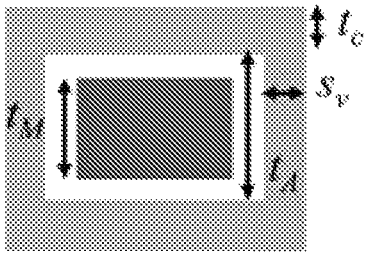

FIG. 2B shows illustrations of four fabricated deformable inductor traces having wavy inductor traces. A one-layer metal lift-off process was used to pattern 500-nm-thick copper inductors on a 2-nm chromium adhesion layer. A trace width of 100 μm was used to maintain consistency with the modeling results. Three sets of inductors were fabricated, all square with 10-mm outer diameter. The first two traces (top left) and (top right) are one-turn inductors based on each form of interconnect. The mutual inductance is small (~20% of the total inductance), and the self-inductance is, therefore, going to dominate the overall inductor performance. In the third trace (bottom left), two single-turn inductors are shown, one nested within the other, enable mutual coupling between the deformable interconnect. Finally, in the fourth trace (bottom right), a set of three-turn inductors provides higher inductance density.

In other embodiments, the deformable electrode 30 may be formed of at least one deformable channel containing a liquid conductor. The channel(s) may be fabricated of a deformable conduit which holds said conductor. The liquid conductor may be a liquid metal, such as Galinstan (an alloy of gallium, indium and tin), eutectic gallium/indium, or mercury. Liquid polymer composites could also be used; these can include flowable elastomers loaded with conductive particles, like carbon nanotubes or gold nanoparticles, for instance. Alternatively, aqueous conductive solutions of ionic conductors or electrolytes, such as salt water loaded hydrogels, for example, can also be used. It is noted that while aqueous (water) solutions can be used, they can be problematic for the reason water tends to evaporate very easily. Thus, fluid solutions of ethylene glycol, propylene glycerin, and glycol with the ionic conductors or electrolytes can be used instead, for example.

The liquid conductors flow to conform to the surrounding channel when stretched or otherwise elastically deformed. A liquid metal inductor was described in A. Fassler and C. Majidi, "Soft-matter capacitors and inductors for hyperelastic strain sensing and stretchable electronics," Smart Mater. Struct., vol. 22, 2013, 055023 (8 pp), herein incorporated by reference it its entirety. That article reports forming capacitors and inductors composed of microchannels of Galinstan alloy embedded in a soft silicone elastomer (Ecoflex® 00-30). A technique for fabricating a non-magnetic core inductor using liquid metal was reported in Lazarus, N.; Meyer, C. D.; Bedair, S. S.; Nochetto, H.; Kierzewski, I. M. "Multilayer Liquid Metal Stretchable Inductors," Smart Mater. Struct. 2014, 23, 085036, herein incorporated by reference it its entirety. This article describes using 3-D printed molds to create multilayer open channels in soft silicone, which are then sealed by bonding to partially cured silicone. Galinstan or other liquid metal is then injected into the channels to form deformable conductive traces. This same technique can be extended to use ferroelastomers.

This novel technology opens up a broader range of applications that are currently impossible with rigid conventional magnetic core inductors and which have been impractical for conventional stretchable ones due to the lower performance. The novel deformable inductive devices may be used for a variety of application, such as bio-medical monitoring, strain (e.g., mechanical displacement) sensing, and stretchable RF ID tags intended to be attached to a surface such as human skin, for example. Other applications include creating a mechanically tunable inductor (allowing an inductor-capacitor circuit used in a transmitter or receiver to be tuned by mechanically stretching or compressing the inductor). Stretchable (and compressible) inductors and transformers for electrical power conversion are also envisioned, which require highly efficient and low resistance components to minimize power losses, and can be used for applications in power generation (in allowing conversion systems to be placed in close proximity to an energy source such as a solar cell mounted on a helmet, which requires the inductor to conform to a non-planar or irregular surface). These novel deformable power conversion elements could lead to a truly deformable computer. Other potential applications of the technology include stretchable filters, communication circuitry, among many other possibilities where conventional inductors are used.

FIG. 3 depicts an analytical model developed for modeling the effects of strain on a liquid-core solenoid inductors. It shows a solenoid topology that was chosen by the inventors to model a deformable inductor having a liquid magnetic core. FIG. 3A shows the solenoid in an initial (unstretched) state and FIG. 3B shows the solenoid after being stretched. FIGS. 3C and 3D further show the bottom and cross-sectional views of the solenoid, respectively, along with some key parameters of the solenoid identified.

The solenoid inductor can be formed of a coil of wire wrapped along the length of a straight core. The core could be assumed be a non-magnetic ("air core") or high permeability material ("magnetic core"). Since the magnetic field is constrained on the inside of the coil, the coupling between neighboring traces and therefore the inductance is directly related to the core permeability. As a result, this geometry is well-suited for demonstrating the effects of a given magnetic material.

As a classic inductor geometry, a number of different techniques exist for analyzing the structure. Here, the core is only partially filled with ferrofluid. The remaining portion of the core is an elastomer material (such as non-magnetic silicone) which define the channels and separate the ferrofluid from the conductive traces. To incorporate this effect, the approach reported by D, Lee, et al., "Fabrication and analysis of high-performance integrated solenoid inductor with magnetic core," IEEE Trans. 2008 Magn. 44 4089-95 was taken, with the inductance of an air core solenoid first calculated and then an additional term ΔL added to account for the effects of the enclosed magnetic core. The Wheeler formula for the inductance of an air core solenoid is:

$$L_{AC} = \frac{10\pi\mu_0 N^2 r^2}{9r + 10I_A}, \tag{1}$$

where $\mu_0$ is the permeability of free space, N is the number of turns of the inductor and r is:

$$r = \sqrt{\frac{(w_A + 2s_V)(t_A + 2t_C)}{\pi}} \tag{2}$$

with geometric parameters defined in FIGS. 3 (*c*)-(*d*). As the magnetic core is added, coupling will improve between the turns of the coil to result in a higher total inductance. This increase is however not entirely proportional to the permeability. The magnetic field within the core also is affected by the core geometry, which acts to reduce the effective magnetization, an effect that can be modeled by a geometry-specific constant (the demagnetizing factor). Adding a magnetic core results in an increase in the inductance by:

$$\Delta L = \frac{\mu_0\mu_r N^2 w_M t_M}{I_M[1 + N_d(\mu_r - 1)]} \tag{3}$$

with $\mu_r$ the core relative permeability and $N_d$ the demagnetization factor of the core. For the rectangular core geometry used here, the appropriate demagnetization factor can be obtained from published tables for rectangular prisms.

For a deformable or stretchable inductor, one of the most important aspects is the behavior of the inductor during stretching. Inductance is highly geometry dependent, so stretching is expected to have a large effect on the electrical performance. As the electrode (traces) stretch, the dimensions and spacing change, resulting in variations in the electromagnetic coupling and resulting inductance.

To understand the behavior during an applied strain, it is first necessary to model the change in geometry as the device stretches. Although the physical structure is complicated, it is possible to make the assumption that, with liquids for both the magnetic core and metal conductors, the mechanical behavior is dominated by the surrounding material defining the fluidic channels. Stretchable devices made in soft elastomeric polymers, such as silicone, are nearly incompressible with strain. This means that the total volume is essentially unchanged during stretching, requiring the strains along each axis to be related by:

$$(1+\varepsilon_x)(1+\varepsilon_y)(1+\varepsilon_g)=1, \tag{4}$$

where $\varepsilon_x$, $\varepsilon_y$ and $\varepsilon_z$ are the strains in the x, y and z directions, respectively as defined in FIG. 3(*a*). For a uniaxial strain $\varepsilon_{applied}$ along the x direction, and assuming isotropic behavior, the resulting mechanical stretch λ (defined as one plus the mechanical strain) in each direction is therefore given by:

$$\lambda_x = 1 + \varepsilon_{applied} = \lambda_{applied}, \tag{5a}$$

$$\lambda_y = \frac{1}{\sqrt{1 + \varepsilon_{applied}}} = \frac{1}{\sqrt{\lambda_{applied}}}, \tag{5b}$$

$$\lambda_z = \frac{1}{\sqrt{1 + \varepsilon_{applied}}} = \frac{1}{\sqrt{\lambda_{applied}}}. \tag{5c}$$

Since the stretch in each direction indicates the change in the overall elastomer (silicone) along the respective axis, it can be used as a scaling factor for the dimensions similarly aligned. For instance, with an applied strain along the core axis, the core length will increase from $l_A$ to $\lambda_x l_A$, and so on. The inductance expressions (1) and (3) can therefore be modified to incorporate the effects of applied strain along the core axis:

$$L_{AC,strained} = \frac{10\pi\mu_0 N^2 \frac{r^2}{\lambda_{applied}}}{9\frac{r}{\sqrt{\lambda_{applied}}} + 10\lambda_{applied} l_A} \approx \frac{L_{AC}}{\lambda_{applied}^2} l_A >> r, \quad (6)$$

$$\Delta L_{strained} = \frac{\mu_0\mu_r N^2 \frac{w_M}{\sqrt{\lambda_{applied}}} \frac{t_M}{\sqrt{\lambda_{applied}}}}{\lambda_{applied} l_M [1 + N_d(\mu_r - 1)]} = \frac{\Delta L}{\lambda_{applied}^2}. \quad (7)$$

Both the equivalent air core inductance and the magnetic core contribution drop quadratically with mechanical stretch along the core. This results from two different effects on the geometry. Since the inductor core is being stretched, but the number of turns is remaining constant, the turns per unit length are dropping linearly. However, the cross-sectional area is also declining with stretch, further reducing the total inductance.

These are the expressions for only one specific inductor design (i.e., the solenoid). However, one skilled in the art should be able to derive similar expressions which can be used to design a deformable inductive devices for alternative inductor geometries.

A molding fabrication process was used by the inventors to fabricate ferrofluid-based inductors. The fabrication process followed the technique previously disclosed in Lazarus, N.; Meyer, C. D.; Bedair, S. S.; Nochetto, H.; Kierzewski, I. M. "Multilayer Liquid Metal Stretchable Inductors," Smart Mater. Struct. 2014, 23, 085036, herein incorporated by reference it its entirety, and having been modified for these devices. Polycarbonate molds were printed using a commercial 3-D printer (Stratasys FDM Titan).

Figure 4A:
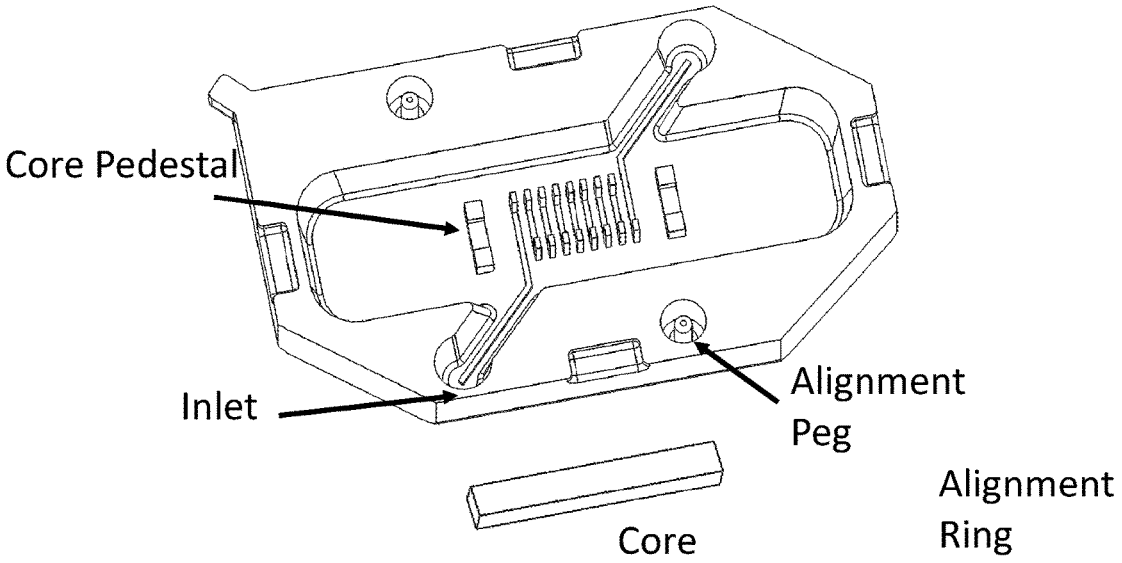
FIGS. 4A and 4B are illustrations showing top and bottom halves of a mold, respectively, which was used by the inventors to fabricate inductive devices.
Figure 4B:
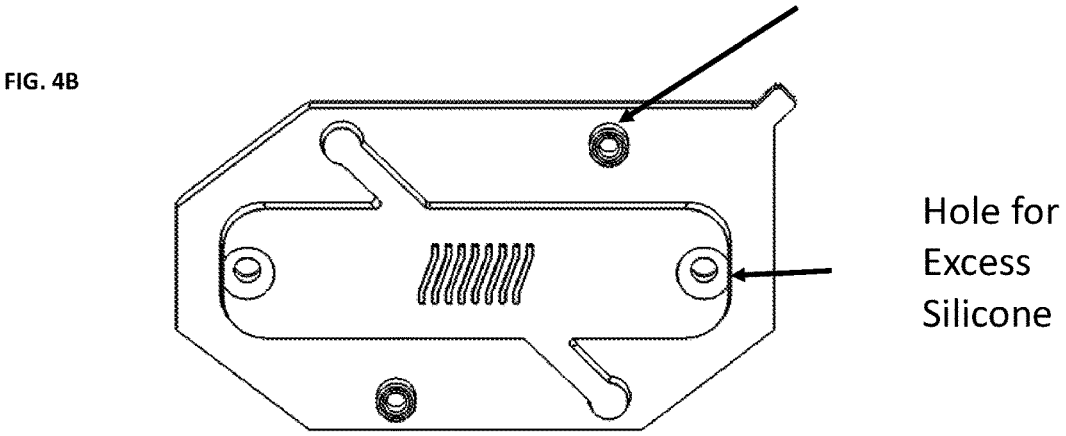

FIGS. 4A and 4B are illustrations showing the top and bottom halves of the mold, respectively, which was used by the inventors to fabricate the devices. The top and bottom molds each have raised features to define the conductive traces for the solenoid, while pillars in the bottom mold create the vertical vias. A third piece or element, e.g., a simple bar which defines the channel for the liquid magnetic core, is placed onto a pedestal on the bottom mold. This bar was made of polycarbonate, but other materials are possible for this element.

In their related paper, see Ref. (1) cited below, the inventors included a sequence of photographs further depicting the fabrication process. Liquid precursors of Ecoflex 00-30 soft silicone (Smooth-on) were first poured into the bottom mold (FIG. 2(a) of Ref. (1)) and de-gassed under vacuum to minimize air bubbling. Additional Ecoflex was also dropped onto the features of the top mold and degassed, after which the top mold was then placed onto the bottom mold. Simple ring-peg features in the mold were used to align the two layers. A weight was then placed on top of the molds to apply pressure followed by curing at 85° C. for approximately 1 hour.

After curing, the bar element was removed from the mold (FIG. 2(b) of Ref. (1)). At this stage, the polycarbonate piece defining the core remained embedded within the silicone. Since silicone does not adhere well to polycarbonate, it was possible to pull the embedded piece out from the side (FIG. 2(c) of Ref. (1)), creating a void for the ferrofluid that is isolated from the channels defining the inductor traces. (In some cases, though, it might be necessary to core holes in the vertical vias, such as using a thin gauge syringe tip, due to imperfect contact between the top and bottom molds).

The bottom channels were then sealed by placing the molded piece onto a layer of Ecoflex 00-30 precursors that had been allowed to partially cured for an hour and fifteen minutes at room temperature (FIG. 2(d) of Ref. (1)). The precursors were then allowed to cure completely. This process was repeated to seal the top layer of channels. Partially curing the silicone allows bonding while minimizing the risk of liquid silicone wicking into the fluidic channels. Inlet and outlet holes were then cored using a syringe tip, followed by injection of liquid metal and ferrofluid (FIG. 2(e) of Ref. (1)).

The liquid metal used by the inventors here was galinstan, an alloy of indium, gallium and tin with conductivity $3.46\times 10^6$ S $m^{-1}$ and melting point −19° C. Unlike mercury, galinstan and other similar gallium alloys are relatively non-toxic, but form a thin gallium oxide layer several nanometers thick with exposure to air. This oxide is self-limiting but will re-form if the oxide is broken by stretching the liquid metal; the long term effects of repeated stretching and oxidation on the electrical properties are not currently known, but the resistance remained stable over the course of this work. Finally, drops of liquid silicone precursor are used to seal the injection holes.

Devices based on two ferrofluids of different permeabilities were fabricated by the inventors with geometric parameters shown in Table 1, below, using the aforementioned molding process, followed by uniaxial strain testing to verify the model. Two hydrocarbon-based ferrofluids were used, EFH1 and EMG900 (Ferrotec), with initial relative permeability 3.64 and 19.6 respectively according to the manufacturer specifications.

TABLE 1

Fabricated inductor geometry.

| Description | Symbol | Dimension |
|---|---|---|
| Air (magnetic) core length | $l_A$, $l_M$ | 21 mm |
| Air core width | $w_A$ | 7 mm |
| Air core thickness | $t_A$ | 6 mm |
| Magnetic core width | $w_M$ | 5 mm |
| Magnetic core thickness | $t_M$ | 4 mm |
| Via width | $s_V$ | 2 mm |
| Trace thickness | $t_c$ | 1 mm |
| Number of turns | N | 8.5 |

Figure 5:
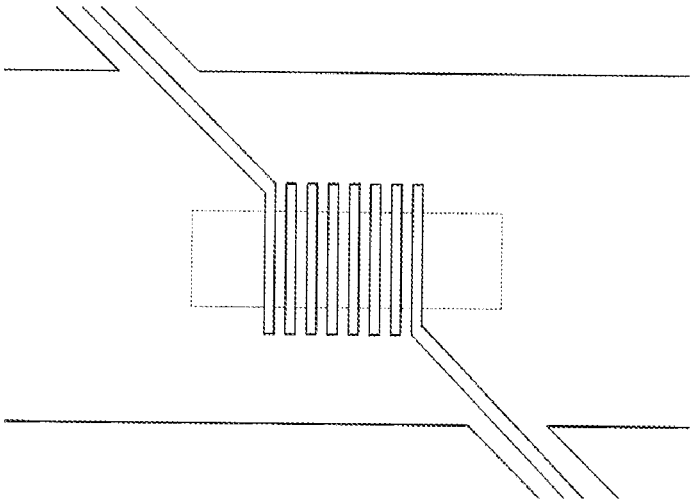
FIG. 5 is an illustration showing one exemplary inductor device that was fabricated.

FIG. 5 is an illustration showing one exemplary inductor device that was fabricated by the inventors. The electrode trace is a coil which the turns are clearly visible at the surface. The liquid magnetic core can be seen just below the surface.

The electrical behavior of the fabricated devices were measured before and after fill of the liquid magnetic core. Measurement were made using a precision impedance analyzer (Agilent 4294A, 40 Hz-110 MHz).

Figure 6:
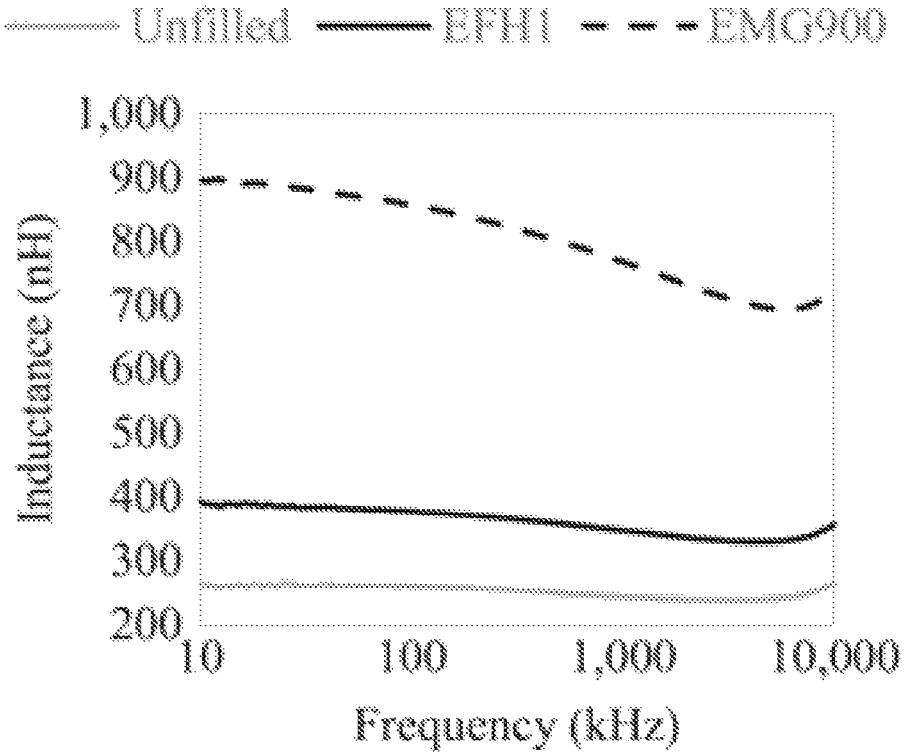
FIG. 6 is a plot showing the frequency response of fabricated devices.

FIG. 6 shows the frequency response after the subtraction of a fixed calculated value for the input traces. The low frequency inductance increases from approximately 260 nH before fill to 390 nH and 900 nH, corresponding to rises of 50% and 246% for EFH1 and EMG 900 respectively. This compares to analytical values of 310 nH before, and 526 nH (EFH1) and 736 nH (EMG900) for the filled inductors. This modest deviation likely results from the small number of relatively sparse turns used for the inductors here. The Wheeler formula used is derived empirically from common solenoid geometries, which have a high density of turns to maximize coupling between traces and therefore inductance density. With a sparser coil the coupling is weaker than predicted, resulting in the lower inductance measured.

Adding a magnetic material increases the inductance but can also cause additional losses within the inductor, particularly at higher frequencies. This results from a number of different physical phenomena including eddy currents generated within the core, magnetic hysteresis losses and displacement currents through the core material. Using a non-conductive core material such as a ferrite is one method of minimizing these losses through reducing eddy currents within the material. Although the ferrofluids investigated are both based on proprietary formulas, the magnetic particulate in both are listed as magnetite, a type of ferrite, and are therefore expected to have relatively low losses.

Figure 7A:
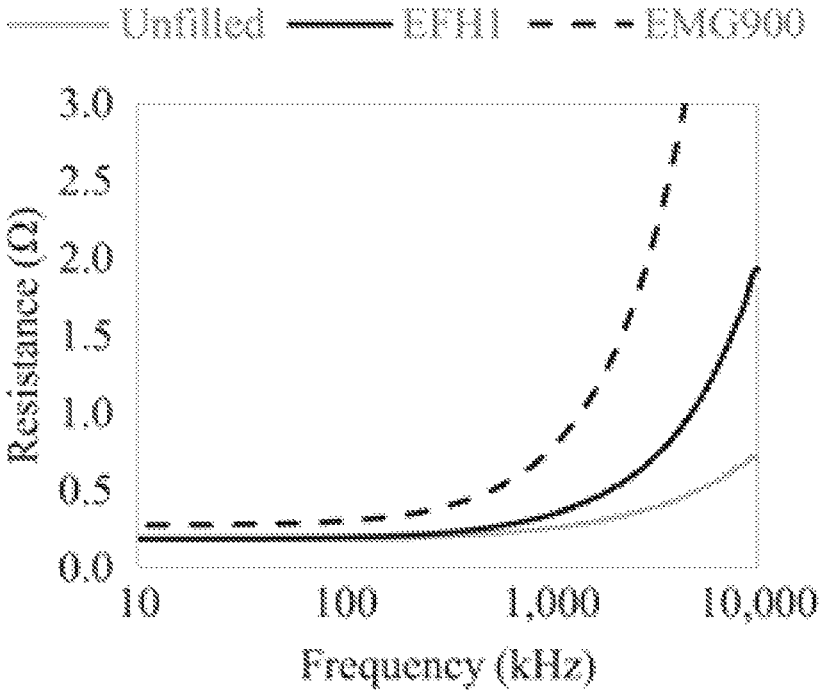
FIGS. 7A and 7B are plots of resistance and quality factor, respectively, for inductive devices measured across vary frequencies.
Figure 7B:
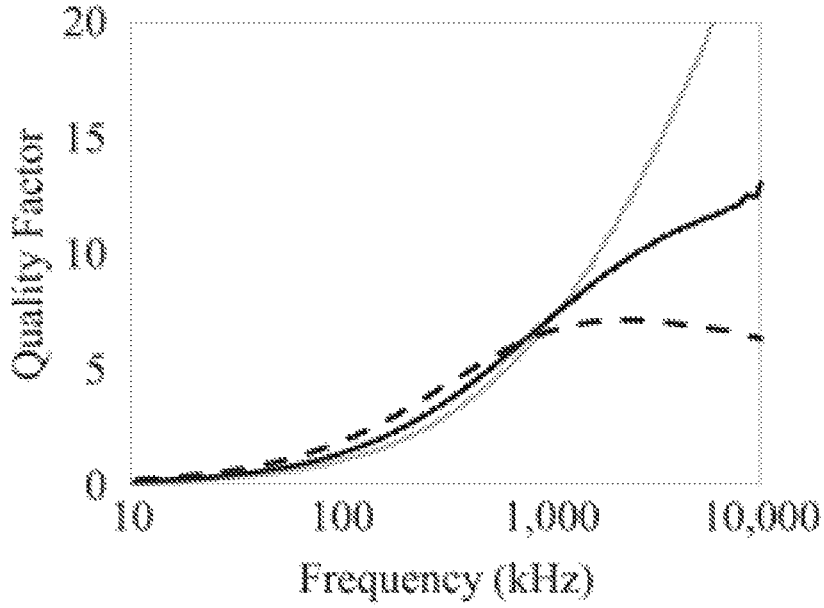

FIGS. 7A and 7B are plots of resistance and quality factor, respectively, across vary frequencies. In the plot of FIG. 7A, the AC resistance of each inductor was measured using the impedance analyzer. At lower frequencies, the measured resistances are 178 mΩ, 185 mΩ and 272 mΩ for the silicone, EFH1 and EMG900 cored inductors respectively. As expected the AC resistance increases more rapidly for both the two ferrofluid inductors compared with the non-magnetic silicone core, diverging at roughly 200 kHz for the higher permeability EMG900 and roughly 900 kHz for the EFH1.

The plot in FIG. 7B shows quality factor. This is one of the main metrics for the performance of an inductor; it represents a measure of how efficiently a component stores energy. The quality factor of an inductor is the ratio of its reactance to its series resistance or:

$$Q = \frac{2\pi fL}{R_s}, \tag{8}$$

where L, $R_s$, and f are the inductance, series resistance and frequency of operation respectively.

Since the EMG900 inductor has several times higher inductance than the other two inductors, it performs well at lower frequencies despite a higher AC resistance. As the plot shows, the quality factor is approximately double at 10 kHz, and remains higher than the silicone inductor up to approximately 950 kHz. The EFH1 inductor quality factor is a maximum of 36% higher than the silicone inductor, and is higher over a comparable frequency range, with a crossover at 1.2 MHz. At high frequencies, non-magnetic cored inductors store energy more efficiently than those with magnetic materials, resulting in better performance. The frequency range demonstrated here is also consistent with other work with ferrite-based materials. Ferrite is most commonly used at lower frequencies, up to a few hundred kilohertz; in the low megahertz range ferrites become increasingly lossy and less practical for inductor applications.

To verify the mechanical models developed for the inductance with strain, uniaxial strain testing was performed on each of the three inductors. The testing results are included in the inventors' related paper, see Ref. (1) cited below, where its FIG. 7 shows photographs of a custom strain testing apparatus used to stretch the EFH1 and EMG900 inductors fabricated by the inventors. The top photograph there shows the initial position where strain is 0% and the middle and bottom photographs there show stains of 50% and 100%, respectively.

The testing apparatus is formed of 3D printed clamps to hold ends of the inductive device. It is designed to be held and enable stretching using a standard bench vise. A similar geometry inductor with a non-magnetic silicone core was also tested using the same apparatus for comparison. All three inductors survived uniaxial mechanical strains up to 100%

Figure 8:
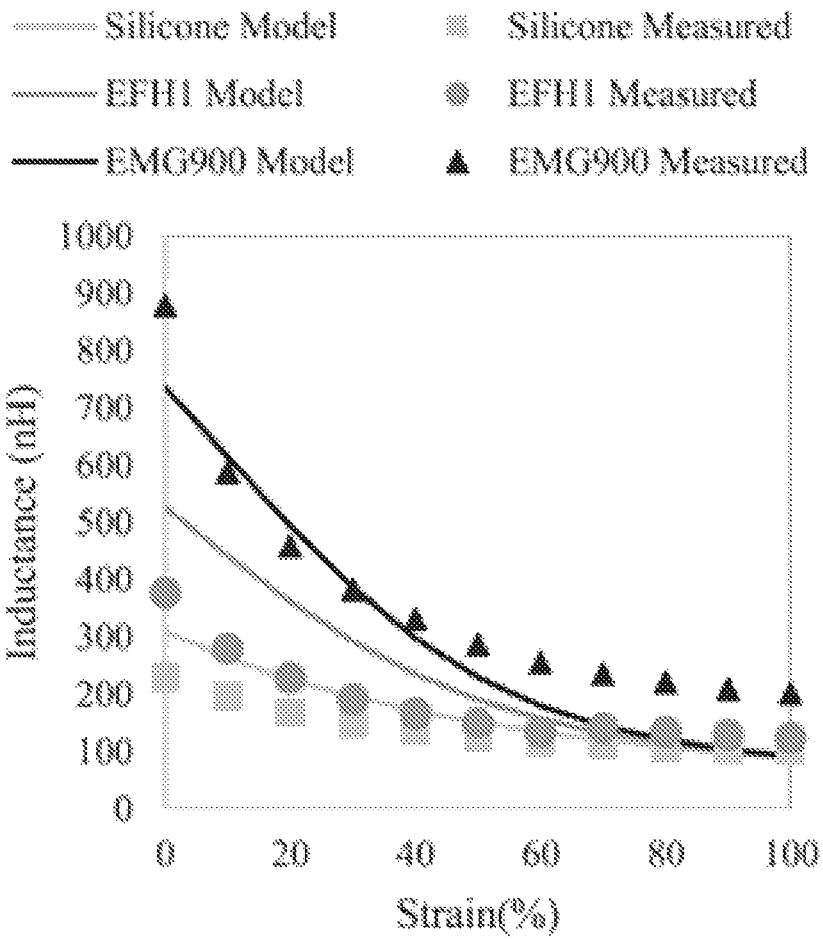
FIG. 8 is a plot of measured inductance for different levels of applied uniaxial strain, along with the predictions of the analytical model.

FIG. 8 is a plot which shows measured inductance for different levels of applied uniaxial strain, along with the predictions of the analytical model. Aside from the deviation previously noted in the initial unstrained inductance, the response behavior closely matches that expected from the model. At low strains, the added ferrofluid results in a large increase in the inductance. As the inductor is stretched, the inductance drops both for the silicone and ferrofluid filled inductors. However, due to the reduction in the cross section of the core, the benefit of the magnetic material drops significantly for high strains, approaching the value for the silicone core. The electrical resistance also increases with applied mechanical strain. Up to approximately 50% strain applied along the core axis, the resistance closely matches the analytical model; above this point the resistance increases faster than predicted, possibly due to partial pinch-off of the channels.

The impact of a larger drop in inductance may vary based on a particular application. An increased mechanical response corresponds to a higher sensitivity and therefore better ability to resolve small changes in strain. Liquid metal devices such as antennae have also been proposed as tunable components, stretching to deliberately change the component value, where again a high sensitivity to mechanical stretching is an asset. For applications such as wireless power or power conversion consistent performance is more desirable for maximizing power efficiency.

Figure 9:
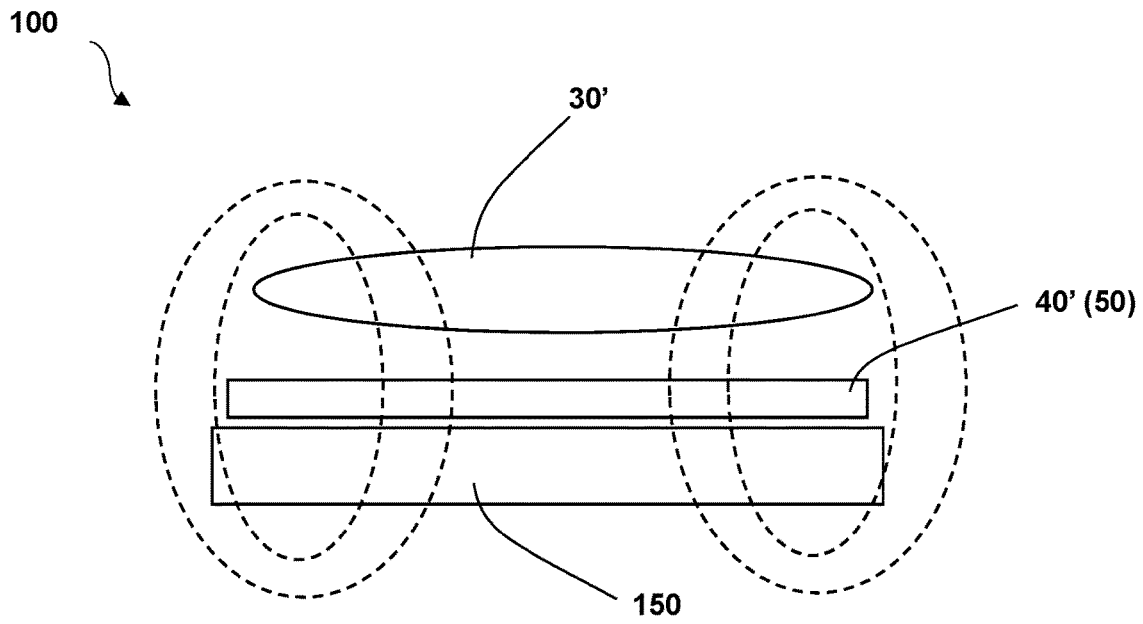
FIG. 9 shows a wireless power transfer system comprising a coil and a magnetic backplane which includes the liquid magnetic core with the coil being attached to or in close proximity to the magnetic backplane according to an embodiment.
Figure 10:
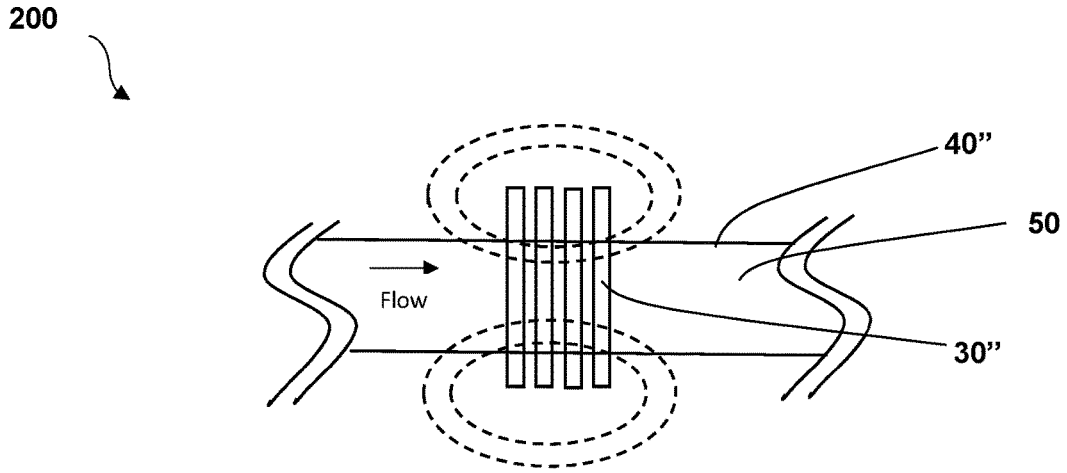
FIG. 10 shows a stretchable system having a stretchable inductor formed around a liquid magnetic core used as a micropump according to an embodiment.

Highly deformable inductor cores based on high permeability magnetic liquids have been successfully demonstrated by the inventors. By using a ferrofluid as such a liquid, the inventors showed that the inductance was increased by nearly a factor of 3.5 over an inductor based on non-magnetic silicone-based core. Ferrofluid also provided a doubling of quality factor at low frequencies. In addition to the direct benefits of a higher performance electrical component and direct applications such as a wireless power backplane, this technique also opens up the possibility of new stretchable devices. A similar backplane embodiment was disclosed in the aforementioned '995 patent application. Thus, according to some embodiments, as shown in FIG. 9, the deformable inductive device is part of a wireless power transfer system 100 including a coil 30' and a magnetic backplane 150 which includes the liquid magnetic core 40' containing magnetic liquid 50 with the coil 30' being attached to or in close proximity to the magnetic backplane 150. Also, in other embodiments, as shown in FIG. 10, a stretchable inductor 30" is formed around a liquid magnetic core 40"; this is ideal for integrating an embedded magnetic micropump within a stretchable system 200 to generate a flow of the magnetic liquid 50 in the liquid magnetic core 40". Exemplary magnetic flux generated by the coil 30' and the inductor 30" is depicted as dotted lines in these two figures.

Aspects related to this invention have been previously disclosed in:

Ref. (1): N. Lazarus and C. D. Meyer, "Stretchable inductor with liquid magnetic core," Mater. Res. Express 3 (2016) 036103, which published 18 Mar. 2016; and Ref. (2): N. Lazarus and C. D. Meyer, "Ferrofluid-based Stretchable Magnetic Core Inductors," Journal of Physics: Conference Series 660 (2015) 012007 (paper presented Dec. 2, 2015 at the PowerMEMS 2015 Conference, Dec. 1-4, 2015, Boston Mass.).

Each of these papers is herein incorporated by reference in its entirety.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

We claim:

1. A passive, deformable inductive device comprising:
an elastomer material;
at least one deformable electrode at least partially embedded in the elastomer material; and
a liquid magnetic core formed in the elastomer material and containing a magnetic liquid,
wherein both the liquid magnetic core and the at least one deformable electrode are not actively-deformed with ordinary operation of the device yet are configured so as to be readily elastic at greater than ±5% strain and maintain operability of the device.

2. The device of claim 1, wherein the deformable inductive device is configured as an inductor, solenoid, or transformer with the at least one deformable electrode is positioned proximate to the liquid magnetic core such that (i) electrical current flowing in the at least one deformable electrode induces magnetic flux in the liquid magnetic, and/or (ii) changing magnetic flux in the liquid magnetic induces electrical current flowing in the at least one deformable electrode.

3. The device of claim 1, wherein the deformable inductive device is part of a wireless power transfer system comprising a coil and a magnetic backplane which includes the liquid magnetic core with the coil being attached to or in close proximity to the magnetic backplane.

4. The device of claim 1, wherein the elastomer material comprises a polymer or plastic material.

5. The device of claim 4, wherein the polymer comprises natural rubber or a silicone material.

6. The device of claim 1, wherein the magnetic liquid comprising a fluid having magnetic particles dispersed within.

7. The device of claim 6, wherein the fluid comprises mineral oil.

8. The device of claim 1, wherein the magnetic particles have a size on the order of 10 nm.

9. The device of claim 1, wherein the magnetic liquid comprises a ferrofluid or magnetorheological fluid.

10. The device of claim 6, wherein the magnetic particles are formed of iron, nickel, cobalt and/or an alloy thereof, or carbonyl iron.

11. The device of claim 6, wherein the magnetic particles are generally spherical particles or platelets.

12. The device of claim 1, wherein the deformable electrode comprises at least one deformable conductive trace or at least one coil having one or more turns.

13. The device of claim 12, wherein the at least one deformable conductive trace is 500 nm thick and 100 μm wide.

14. The device of claim 1, wherein the deformable electrode comprises at least one deformable channel containing a containing a liquid conductor.

15. The device of claim 14, wherein the liquid conductor comprises a liquid metal, flowable elastomer or polymer having conductive particles intermixed therein, or a fluid solution containing an ionic conductor or electrolyte.

16. The device of claim 15, wherein the liquid metal comprises Galinstan, eutectic gallium/indium, or mercury.

17. The device of claim 1, wherein the stretchable inductive device is configured to be elastically deformable from −50% strain to 100% strain.

18. A method for forming the deformable inductive device of claim 1, comprising the steps of:
preparing a mold, the mold including a removable element which will form the liquid magnetic core in the elastomer material;
casting elastomer material into the mold;
removing the removable element; and
filling the void in the elastomer material left by the removable element with the magnetic liquid.

19. The device of claim 1, wherein the device is configured to generate a flow of the magnetic liquid in the liquid magnetic core.

20. A passive, deformable inductive device comprising:
an elastomer material;
a liquid magnetic core formed in the elastomer material and comprising at least one channel containing a ferroliquid; and
a deformable electrode at least partially embedded in the elastomer material,
wherein both the liquid magnetic core and the deformable electrode are not actively-deformed with ordinary operation of the device yet are configured so as to be readily elastic at greater than ±5% strain and maintain operability of the device.

* * * * *